US009290347B2

(12) United States Patent
Mazzaccherini et al.

(10) Patent No.: US 9,290,347 B2
(45) Date of Patent: Mar. 22, 2016

(54) DEVICE AND A METHOD FOR EXTRACTING WINDING SPINDLES FROM A LOG OF WEB MATERIAL

(75) Inventors: Graziano Mazzaccherini, Porcari (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 339 days.

(21) Appl. No.: 14/001,011

(22) PCT Filed: Feb. 21, 2012

(86) PCT No.: PCT/IT2012/000051

§ 371 (c)(1),
(2), (4) Date: Aug. 30, 2013

(87) PCT Pub. No.: WO2012/114363

PCT Pub. Date: Aug. 30, 2012

(65) Prior Publication Data

US 2013/0333183 A1 Dec. 19, 2013

(30) Foreign Application Priority Data

Feb. 23, 2011 (IT) ..... FI2011A0032

(51) Int. Cl.
*B65H 19/30* (2006.01)
*B65H 19/22* (2006.01)

(52) U.S. Cl.
CPC .. *B65H 19/2292* (2013.01); *B65H 2301/41818* (2013.01); *B65H 2301/41852* (2013.01); *Y10T 29/49822* (2015.01); *Y10T 29/53991* (2015.01)

(58) Field of Classification Search
CPC ..... B65H 19/2292; B65H 2301/41818; B65H 2301/41852; B65H 19/12; B65H 19/126; B65H 20/16; B65H 20/18; B65H 27/00; B65H 67/00; B65H 67/02; B65H 2301/4134–2301/41344; B65H 2301/4185–2301/41854; B65H 19/305; Y10T 29/53991; Y10T 29/49822
See application file for complete search history.

(56) References Cited

U.S. PATENT DOCUMENTS

| | | | | |
|---|---|---|---|---|
| 2,772,838 | A * | 12/1956 | Bernhard Lenz | 242/533.3 |
| 4,030,681 | A | 6/1977 | Schott, Jr. | |
| 4,583,698 | A | 4/1986 | Nistri et al. | |
| 5,242,525 | A | 9/1993 | Biagiotti | |
| 5,716,489 | A | 2/1998 | Biagiotti | |
| 5,979,818 | A | 11/1999 | Perini et al. | |
| 6,143,111 | A | 11/2000 | Biagiotti | |
| 6,565,033 | B1 | 5/2003 | Biagiotti | |
| 6,729,572 | B2 * | 5/2004 | Baggot et al. | 242/532.2 |
| 8,713,779 | B2 * | 5/2014 | Acciari | 29/426.2 |
| 2003/0057314 | A1 | 3/2003 | White | |
| 2010/0243789 | A1 | 9/2010 | Acciari | |

FOREIGN PATENT DOCUMENTS

| | | | |
|---|---|---|---|
| GB | 2268477 | A | 1/1994 |
| WO | 0240387 | A1 | 5/2002 |
| WO | 2010100666 | A1 | 9/2010 |

* cited by examiner

*Primary Examiner* — David Bryant
*Assistant Examiner* — Jun Yoo
(74) *Attorney, Agent, or Firm* — Breiner & Breiner, L.L.C.

(57) ABSTRACT

The device includes at least a first gripping member and a second gripping member, arranged and controlled so that they extract two winding spindle portions from opposite ends of a log in a longitudinal extraction direction parallel to the axis of the log. The first gripping member and a second gripping member are movable along a log advancing path and extract the two winding spindle portions as they advance along the log advancing path together with the log and the two winding spindle portions.

33 Claims, 9 Drawing Sheets

35A
35B
V3
V1
V2
VR
V2=VR
21
25
R
M
M1
M2
f41
f43
f12
41
43
45
47
49
51
53
55
57
65
67
69
71
73
75
77
79
81
83
85
87
36
38

VIA
VIB
43
102B=102A
79C
79A
C
80
M2
107B
107A
107
101
102B
102A
103
104A
82
79B
109A
109B
109
104B
79
104A=104B
M
M1

DEVICE AND A METHOD FOR EXTRACTING WINDING SPINDLES FROM A LOG OF WEB MATERIAL

TECHNICAL FIELD

The present invention relates to improvements to machines for producing logs of wound web material and, more particularly, to devices for removing winding spindles from completed logs.

BACKGROUND OF THE INVENTION

In a number of industrial fields it is necessary to wind a web material around a winding spindle or core that is subsequently extracted from the completed log. Particularly in the field of paper converting, for instance, in the production of logs of toilet paper, kitchen paper or other so-called "tissue" paper products, rewinding machines are used that wind a preset quantity of web material around a central winding core. In some cases, this central winding core consists of a tubular element made of cardboard or plastic that remains inside the log. In other cases, the winding spindle or winding core is extracted from the completed log so that the log can be further processed, e.g. divided into rolls of smaller axial dimension, and packaged without the winding core or spindle inside. The winding spindles extracted from the logs are recycled and returned to the rewinder.

U.S. Pat. No. 6,565,033 describes a rewinder that uses a system for winding on a removable spindle. In this case, the removable spindle is made in two coaxial portions that are coupled together to form a complete spindle, on which the log is wound. Once the log has been completed, it is unloaded from the rewinder and the spindle is extracted, removing the two spindle portions from the two opposite ends of the finished log. This solution offers a number of advantages, particularly enabling a better distribution of the space needed alongside the rewinder to complete the spindle extraction process, as well as halving the time it takes to remove the spindle from the log, given the same extraction rate. In addition, extracting the two spindle portions from opposite sides of the log enables the friction forces between the semi-spindles and the wound material to be balanced, thereby reducing or eliminating the force that would otherwise have to be exerted to keep the log axially steady while the spindle is removed.

The steps needed to extract the spindle are completed while the spindle is retained at an extraction station downstream from the log winding area. These spindle extraction steps take a certain amount of time and occupy a part of the processing line. Extractable spindles are currently used for winding logs of relatively large dimensions, i.e. containing relatively large quantities of web material, that consequently take a considerable amount of time to wind (typically several seconds). In this case, the time taken to complete the winding process is compatible with the time it takes to extract the spindles from the log being unloaded from the rewinder.

There are also rolls of paper or other web material on the market, however, on which only a limited quantity of material is wound and they consequently take very little time to be wound (typically 1-2 seconds). In addition, the growing tendency to produce faster and faster rewinders leads to a continuous reduction in the time taken to wind a single log.

When the log winding time becomes so short (either because of the high speed of the rewinder or because of the limited amount of material wound onto each log), the use of removable spindles becomes troublesome because the extraction of the spindle becomes a step with a far from negligible influence on the total time taken to produce a log.

EP-A-135662 describes a rewinder in which the winding process takes place around tubular cores that engage at the ends with tailstocks moving along a closed path that extends from a position for gripping the tubular winding cores to a winding area between winding belts, and from there to and unloading area. The tailstocks are movable so that they can engage with and release the single winding cores.

SUMMARY OF THE INVENTION

According to one aspect, this invention proposes a device for extracting winding spindles from logs of wound web material that completely or at least partially overcomes at least one of the drawbacks of the known state of the art.

Essentially, according to one embodiment, the invention involves a device for extracting winding spindles from logs of web material wound around said winding spindles, comprising at least one first gripping member and one second gripping member, arranged and controlled so that they extract two winding spindle portions from opposite ends of a log, wherein the first gripping member and the second gripping member are movable along a log advancing path and extract the two winding spindle portions as they advance together with the log and the two winding spindle portions along the log advancing path. The forward movement of the gripping members during the extraction of the spindle portions enables a reduction in the incidence of the time it takes to extract the spindle portions on the log production rate. In some embodiments, several pairs of spindle portions, corresponding to a plurality of consecutive logs, can be gripped at the same time, thereby further reducing the incidence of the time it takes to extract the spindles from the logs.

In advantageous embodiments, the winding spindle portions are released by the gripping members and carried towards a coupling station or area, where they can form a new winding spindle. A recirculating path enables the spindle portions, either uncoupled or already coupled together again, to be transferred from an area where they are released by the gripping members to an area where they are fed back into the rewinder. In advantageous embodiments, the gripping members move along respective closed paths, which are distinct from the path for recirculating the spindles or spindle portions.

The first gripping member and the second gripping member can advantageously be controlled so that they move along diverging trajectories alongside the log advancing path. In this way, a pair of respective first and second gripping members advances in a manner coordinated with the respective log, engaging with the two ends of the two spindle portions projecting from the log. Each gripping member moves with a movement that has a speed component parallel to the direction in which the log advances, and a diverging component, i.e. a component which is substantially orthogonal to the log advancement direction. The two gripping members tend as a result to move away from one another and from the ends of the log advancing with them in the forward feed direction, consequently sliding the two spindle portions out of the opposite ends of the log as the log advances.

In some embodiments, the first gripping member and the second gripping member are part of a first series of gripping members and a second series of gripping members, respectively, each series comprising a plurality of gripping members.

The gripping members in the two series of gripping members can advantageously be moved along two respective closed paths. The two closed paths are preferably symmetrical in relation to one another. They advantageously have two active portions substantially symmetrical in relation to the log advancing path. The term "active portions of the closed path" is used here to mean two portions of the path along which the gripping members act on the spindle portions, engaging with them and subsequently extracting them from the log. The active portions of each closed path can advantageously comprise a portion parallel or substantially parallel to the direction in which the log advances, and a portion diverging with respect to the direction along which the log advances. Along the portion parallel to the log advancing direction, the gripping members are controlled so that they follow and engage with the respective ends of the spindle portions. Along the diverging portions, the gripping members are controlled so that they advance synchronously with the log, i.e. they move with a speed component that is parallel to, and has the same modulus as the speed at which the log advances. At the same time, the gripping members have a movement of mutual separation along the diverging portions, making them slide the spindle portions out of the log.

In some embodiments, the closed paths are defined by guides along which the gripping members are driven. Each gripping member could be fitted with its own actuator making it advance along its closed path. For instance, each gripping member could have an electric motor driving a pinion meshing with a rack extending along the closed path. Preferably, in more economical and straightforward embodiments, the gripping members in a first series are connected by means of a continuous flexible member, such as a chain, and a second series of gripping members are connected to a second flexible member.

Means may be provided for driving the gripping members so that they remain parallel to one another along at least a part of the closed path.

The first closed path along which the first gripping members move, and the second closed path along which the second gripping members move, both define an engaging portion along which the first closed path and the second closed path lie parallel to one another, and an extracting portion along which the first closed path and the second closed path diverge. To extract the spindle portions from a log, a first gripping member and an opposite second gripping member are used, that move respectively along the first closed path and along the second closed path so that they advance along the engaging portion to engage with opposite ends of a winding spindle projecting from the ends of a log, and they advance along the extracting portion to extract the two winding spindle portions from the log.

In some embodiments, the first gripping member and the second gripping member acting on a log are controlled so that they advance:

- along the engaging portion of the first closed path and of the second closed path at a speed substantially greater than the speed at which the log advances along said advancing path that, wherein said log may even be temporarily at a standstill in this engagement portion;
- and along said extracting portion of the first closed path and second closed path at a speed that has a component parallel to the log advancing path and a component orthogonal to the log advancing path, the component parallel to the log advancing path having a modulus corresponding to the modulus of the speed at which the logs advance.

In some embodiments, a conveyor is provided along the log advancing path that makes the logs advance along said path. This conveyor may comprise a belt, or two overlapping belts, or two systems of belts lying parallel to one another and defining a group of upper parallel belts and a group of lower parallel belts, the log advancing path being defined between opposite branches of the two groups of belts.

In other embodiments, the log may be conveyed by conveyors forming holders or cradles, similar to those of a chain accumulator.

Generally speaking, the logs are preferably fed forward with a translational motion in a direction substantially orthogonal to the axis of the logs.

In some embodiments, the logs from which the spindle portions have been removed may be sent directly to a machine for further processing, e.g. to a cutter. A log stacker is preferably used, however, located downstream from the log advancing path, to receive the logs from which the winding spindle portions have been extracted. The logs can accumulate in the stacker in order to make the speed of the spindle extraction system independent from the speed or production rate of any machine downstream.

After the spindle portions have been removed from the log, they are preferably collected in a conveyor or accumulator. In some embodiments, there may be a containment area consisting of or comprising a simple box for storing the spindle portions, possibly with systems for extracting single spindle portions, e.g. so as to reconnect the spindle portions in pairs to form winding spindles to return to the rewinder or feed to another processing machine. The spindle portions are preferably accumulated on a conveyor system comprising a conveyor on which single spindle portions are stored individually. The conveyor of the spindle portions advantageously comprises two semi-conveyors, each of which can have a pair of chains or other flexible members defining a handling and recirculating path. Holders for supporting and handling the spindle portions are advantageously attached to the chains or other continuous flexible members. The spindle portions are thus handled separately and reconnected pairwise when they are reused or before they are placed in another accumulator or conveyor. This does not rule out the opportunity to re-couple two spindle portions as soon as they are removed from a log before handling them (in the form of a whole spindle), e.g. before transferring them to an accumulator, a conveyor or an area for feeding them into a rewinder to be used in the formation of a new log.

According to another aspect, the invention concerns gluing device for gluing the tail edge of logs of web material wound around winding spindles, wherein a device as defined above is incorporated. In some embodiments, the gluing device comprise a first station for opening the tail edge of the logs and a second gluing station, and said spindle portion removing device is located between said first tail edge opening station and said second gluing station.

According to another aspect, the invention concerns a method for extracting a winding spindle from a log of web material wound around said winding spindle, said winding spindle being made in two portions that are extractable from opposite ends of the log by means of a first and a second gripping member. According to the invention, the log is moved forward along a log advancing path while the two winding spindle portions are gradually extracted from the log by means of said first gripping member and said second gripping member, which advance together with the log along the log advancing path.

Further advantageous features and embodiments of the device and of the method according to the invention are set forth in the attached claims and described in more detail below, with reference to the attached drawings showing non-limiting examples of embodiments of the invention.

BRIEF DESCRIPTION OF THE DRAWINGS

The present invention is easier to understand by following the description and the attached drawings, which show a non-limiting practical embodiment of the invention. More in particular, in the drawings.

DETAILED DESCRIPTION OF EMBODIMENTS OF THE INVENTION

Figure 1:
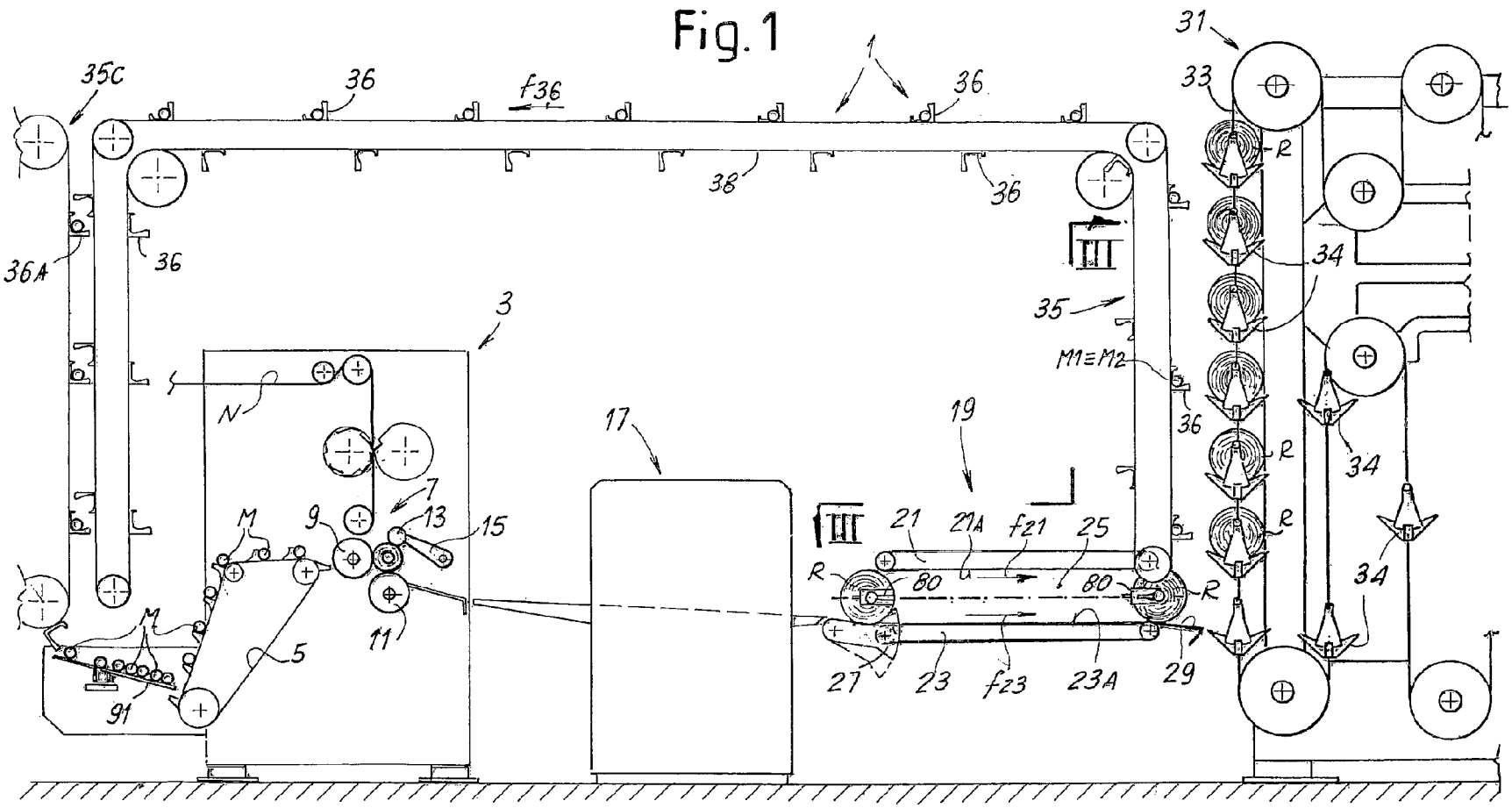
FIG. 1 is a schematic side view of a portion of a winding line for producing logs of wound web material, in which a device according to the invention is inserted.

The invention is described below in its application to a converting line for the production of rolls of paper, and particularly for the production of rolls of tissue paper. This is on the understanding that the invention may also be used in other types of machine, or in other processing lines, systems or the like for producing logs of web material wound around removable spindles and involving the use of extractable winding spindles divided each into two portions that can be removed from opposite ends of the log.

A first embodiment of the invention is described below with reference to FIGS. 1 to 7. The numeral 1 is used to globally indicate a part of a converting line for producing rolls, or logs, of web material and typically paper, such as tissue paper and the like. The converting line 1 comprises a rewinding machine 3, in which a web material N is wound onto winding spindles M that are delivered to the winding area by means of a conveyor 5. The winding area comprises a winding head globally indicated by the numeral 7. In some embodiments, the winding head comprises a first winding roller 9, a second winding roller 11, and a third winding roller 13, supported by mobile arms 15, that enable to gradually distance the third winding roller 13 from the first and second winding rollers 9, 11 to allow the size of the log being formed to increase. The structure of the rewinder 3 is represented very schematically here because the machine can be designed in any manner known to a person skilled in the art, and the structure of the rewinder is irrelevant for the purpose of describing the present invention. An example of a rewinder suitable for use in a processing line in which the present invention can be incorporated is described in U.S. Pat. Nos. 5,979,818 or in 6,565,033.

Downstream from the rewinder 3, there is a gluing device 17 for gluing the free end, or tail edge of the web material wound onto each log coming from the rewinder 3. The structure of this gluing device is also, in itself, known. For instance, the gluing device may be designed as described in U.S. Pat. Nos. 6,143,111, 5,242,525, WO2010100666, or other patent documents referred to in said publications.

Downstream from the gluing device 17, there is a device for extracting the winding spindles from the logs produced by the rewinder 3 and glued by the gluing device 17. The extractor device is globally indicated by the numeral 19. In some embodiments, the device 19 comprises a first conveyor 21 and a second conveyor 23, one lying above the other, that together define a log advancing path 25. In some embodiments, the first conveyor 21 and the second conveyor 23 may each comprise a plurality of juxtaposed parallel belts. The conveyors 21 and 23 advance in the direction of the arrows $f_{21}$ and $f_{23}$ to move the logs R coming from the gluing device 17, preferably according to a simple translational displacement. For this purpose, the distance between the lower branch 21A of the upper conveyor 21 and the upper branch 23A of the lower conveyor 23 is such that it corresponds substantially to the diameter of the logs R coming from the rewinder 3 and from the gluing device 17; alternatively, it may be slightly narrower than said diameter to enable a more efficient gripping of the logs by the opposing stretches of the flexible members forming the conveyors 21 and 23. In some embodiments, said distance may be adjustable to enable logs of various diameters to be processed according to production needs. The opposite stretches 21A and 23A of the conveyors 21 and 23 advantageously advance substantially at the same speed so that the logs held between them advance without rotating, i.e. they advance with a simple translational movement. This does not rule out the possibility of a different speed being adopted for said conveyors, e.g. in order to modify the angular position of the single logs.

In the initial area or entrance of the path 25 along which the logs R advance a distributor 27 is provided, which ensures that only one log R advances at a time along the path 25 by retaining the subsequent log coming from the gluing device 17. In the embodiment illustrated in FIG. 1, the distributor 27 is positioned upstream from the conveyors 21, 23, so that a log R being withheld by the distributor 27 is not yet in contact with the conveyors 21, 23. If the latter move continuously, this solution avoids any slipping of the logs on the conveyors. The logs R are moved forward from the waiting position coinciding with the distributor 27 to the area where they are in contact with the conveyors 21, 23 in a manner described later on. In some embodiments, the forward feed of the logs up until they are inserted between the conveyors 21, 23 can also be achieved by means of a particular shaping of the distributor 27, e.g. with a rotating distributor that transfers singles log by always turning in the same direction, instead of having a reciprocating rotating movement as in the case illustrated.

This does not rule out the feasibility, in a less advantageous embodiment of the invention, of extending the conveyors 21, 23 further upstream of the position shown in the drawing so that the log can be taken up by the conveyors 21, 23 already on a level with the distributor 27.

Downstream from the log advancing path 25, there is a slide 29 along which the logs R are allowed to move, preferably by rolling under the effect of gravity, towards an accumulator of known type, globally indicated by the numeral 31. The accumulator may, for instance, comprise a pair of chains 33, each lying preferably on a vertical plane. The two chains advantageously define two substantially identical closed paths and support a plurality of cradles or channels 34, hinged to the chains 33, for holding the single logs R from which the winding spindles have been extracted by means of the device 19 in the manner described later on.

In the vicinity of the outlet from the conveyors 21 and 23, there is the lower end of an accumulator or a conveyor 35 for receiving the winding spindle portions extracted from the logs R by means of the device 19 and returning them towards the inlet of the rewinder 3.

As described in more detail later on, the conveyor 35 actually comprises two substantially symmetrical semi-conveyors for receiving respective winding spindle portions extracted from the logs R by means of the device 19.

Figure 3:
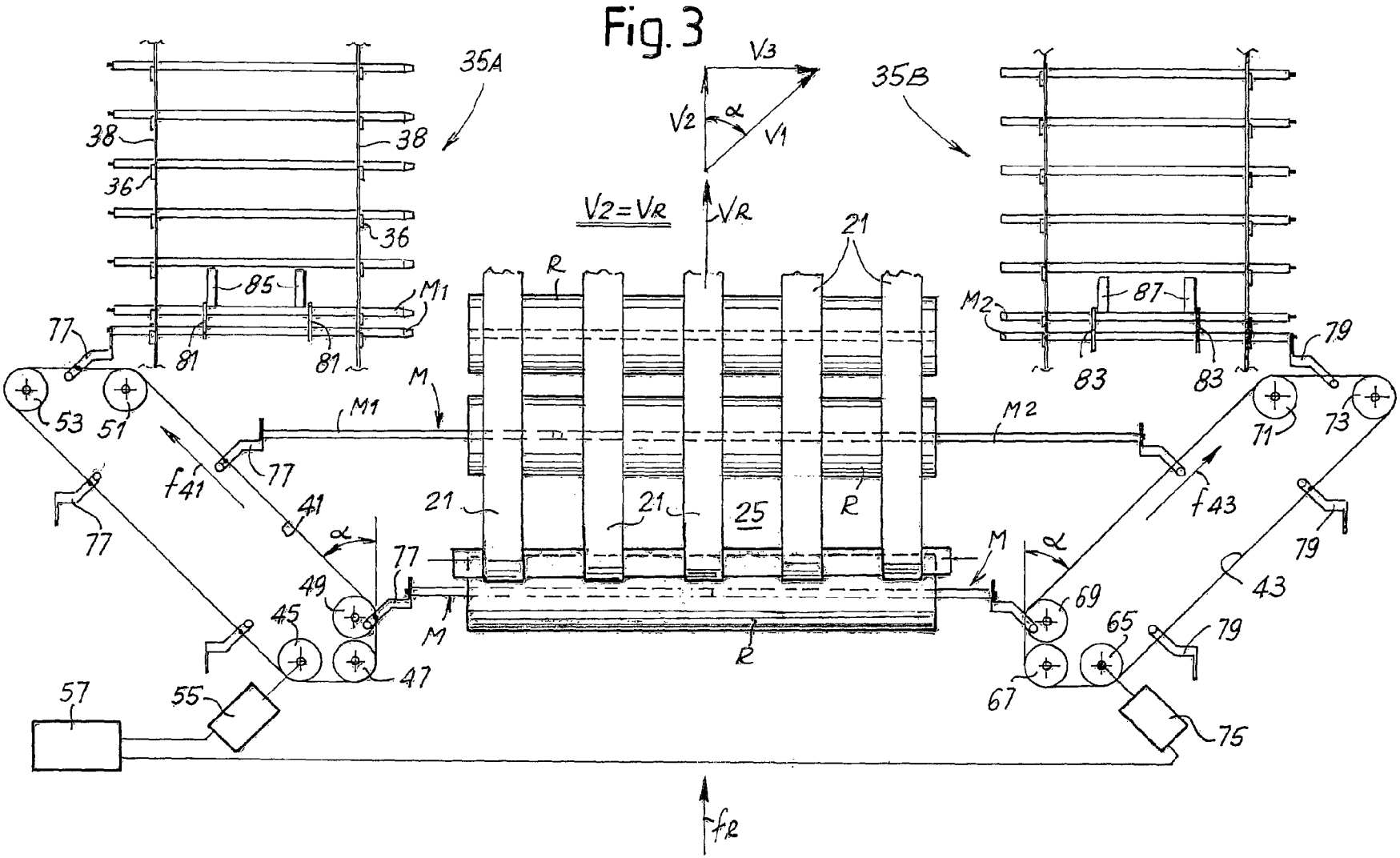
FIG. 3 is a view along of FIG. 1, showing a portion of the line.

FIG. 3 shows the device 19 for extracting the spindles in more detail, in a view along of FIG. 1. This figure shows the upper conveyor 21 represented as a series of parallel belts, underneath which the logs R advance.

In some embodiments, as shown in the drawing, on either side of the log advancing path 25 defined between the conveyors 21 and 23, a first flexible member 41 and a second flexible member 43, substantially symmetrical to one another, are provided. In some embodiments, the flexible members 41 and 43 may comprise chains, belts or other continuous elements. The first continuous flexible member 41 defines a first closed path and the second continuous flexible member 43 defines a second closed path.

In some embodiments, the two closed paths defined by the flexible members 41 and 43 are substantially symmetrical. In the embodiment illustrated, the two closed paths defined by the flexible members 41 and 43 lie on a substantially horizontal plane.

In the embodiment illustrated, the first continuous flexible member 41 is driven around guide wheels 45, 47, 49, 51 and 53, at least one of which is motorized by means of a motor that can advantageously be numerically controlled by a programmable control unit schematically identified by numeral 57 in the drawing. A motor 55 is schematically represented in the example illustrated, associated with the wheel 45 for controlling the movement of the first continuous flexible member 41. It shall be understood that the motor 55 may be differently arranged and associated with any of the wheels from 45 to 53.

The programmable electronic control unit 57 may advantageously also be connected to a second motor for driving the second continuous flexible member 43. In the embodiment illustrated, the second continuous flexible member 43 is driven around guide wheels 65, 67, 69, 71 and 73. In the example illustrated, the wheel 65 is motorized by means of a motor 75, controlled by the central control unit 57.

Associated with the first continuous flexible member, there are gripping members 77 that define a first series of gripping members for engaging with a first portion M1 of each winding spindle M inserted in the logs R coming from the rewinder 3 and advancing through the device 19 along the path 25.

Second gripping members 79 of a second series of gripping members are attached to the second continuous flexible member 43 and intended to engage with the second portion M2 of each winding spindle M inside the logs R delivered from the rewinder 3 and the gluing device 17 to the device 19.

The gripping members 77 and 79 are substantially symmetrical to one another. As shown particularly in FIG. 1, and in the enlargement in FIG. 2, each gripping member 77, 79 has a fork 80 with a slot or recess 82 shaped so that it can engage with a tapered socket C axially extending from one or other of the respective portions M1 and M2 of each winding spindle M. The tapered sockets C are shaped with a head of wider cross section and a neck of narrower cross section, so that when the neck of the tapered socket C engages in the slot 82 the corresponding portion M1 or M2 of the spindle M remains attached to the fork 80, as also shown in particular in the enlargements of FIGS. 5 and 6.

In the embodiment illustrated, as shown in FIG. 3 in particular, the closed paths defined by the first continuous flexible member 41 and the second continuous flexible member 43 comprise a first portion substantially parallel to the forward feed direction $f_R$ of the logs moving along the log advancing path 25. This first portion is defined between the wheels 47 and 49 for the continuous flexible member 41, and between the wheels 67 and 69 for the continuous flexible member 43. This first portion is an engaging portion along which the gripping members 77 and 79 of each pair of gripping members come to engage with the end of a respective spindle that must be removed from the log R wound around it, as explained later on.

A portion of flexible member extending between the guide wheel 49 and the guide wheel 51 defining the closed path of the continuous flexible member 41, diverges, i.e. it moves away from the log advancing path 25. Extending between the wheels 69 and 71 defining the closed path of the second continuous flexible member 43, a symmetrically corresponding portion of said flexible member 43 diverges in a mirror image of the portion of the continuous flexible member 41 diverging from the path along which the logs R advance. The diverging portions of the closed paths defined by the continuous flexible members 41, 43 are the extracting portions, along which the movement needed to extract the spindle portions M1, M2 from the log takes place. The set of the two (engaging and extracting) portions defines an active portion of the closed path along which the gripping members 77 and 79 move.

The speed at which the continuous flexible members 41 and 43 advance has a modulus $V_1$ that is greater than the forward feed speed $V_R$ of the logs along the log advancing path 25. The modulus $V_1$ of the forward feed speed of the continuous flexible members 41 and 43, and the angle $\alpha$ formed between the forward feed direction of the logs along the log advancing path 25 and the direction of the respective diverging stretch or portion between the wheels 49 and 51 of the continuous flexible member 41, or between the wheels 69 and 71 of the continuous flexible member 43, is such that the speed vector $V_I$ can be broken down into two components, respectively $V_2$ (parallel to the speed $V_R$ of the logs moving forward along the path 25) and $V_3$ (orthogonal to the direction in which the logs move forward along the log advancing path 25), and the component $V_2$ has a modulus (corresponding to $V \cos \alpha$) substantially equating to the modulus of the speed $V_R$ at which the logs advance, as represented schematically in the vector diagram in FIG. 3. As a consequence, the gripping members 77 and 79 advance in the direction $f_R$ (i.e. parallel to the forward feed of the logs along the path 25) along the two portions between the wheels 47, 49 for the gripping member 77, and between the wheels 67, 69 for the gripping member 79, at a higher speed than the speed of the logs R advancing along the path 25. The gripping members 77 and 79 are arranged in opposite pairs and these pairs are positioned and displaced in synchronism with the spindles M inserted in the logs R moving along the log advancing path 25 so that, along the first portion of the advancing path, each pair of gripping members 77, 79 follows and ultimately reaches a corresponding spindle M inserted in a log R moving along the log advancing path 25.

Since along the two diverging portions of the closed paths defined by the continuous flexible members 41 and 43 the speed component of the gripping members 77 and 79 parallel to the direction $f_R$ in which the logs move forward along the path 25 corresponds to the forward feed speed $V_R$ of the logs themselves, the gripping members 77 and 79 advance along said portions synchronously with the log R and consequently also synchronously with the spindle M to which they are attached. The presence of a speed component $V_3$ orthogonal to the direction $f_R$ in which the logs move forward along the log advancing path 25 means that, during this forward displacement, the two spindle portions M1 and M2 attached to the first gripping member 77 and the second gripping member 79 of a pair of gripping members 77, 79 are gradually removed from the log R, as shown clearly in FIG. 3.

Figure 4:
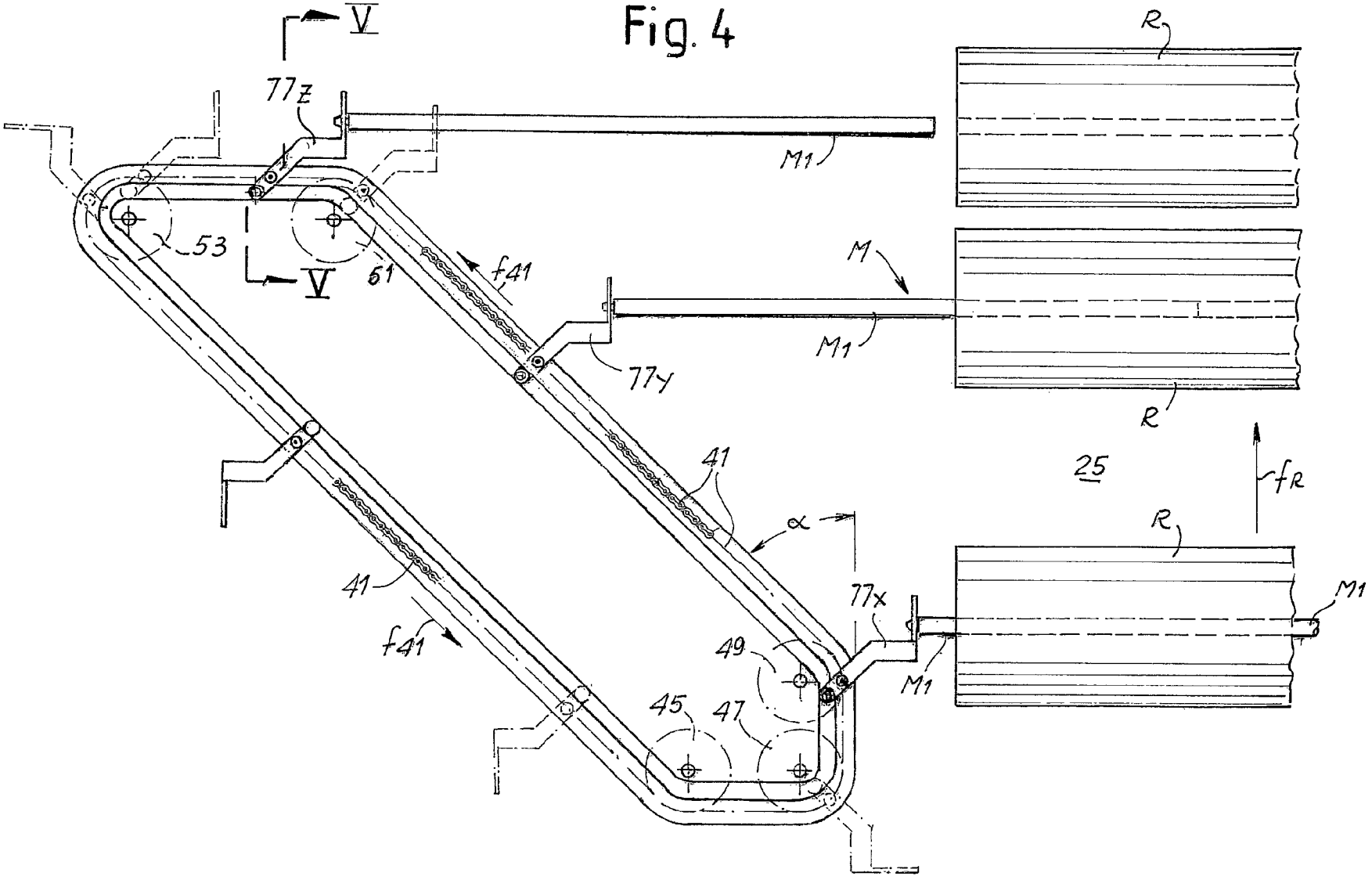
FIG. 4 is an enlargement of a first continuous flexible member to which the gripping members of a first series of gripping members in the spindle extracting device are connected.

FIG. 4 shows a view from above of the flexible member 41 only, with the corresponding gripping members 77, wherein the operation of the system for extracting a portion M1 of spindle M from the log R is clearly shown. In the schematic illustration in FIG. 4, the gripping members 77 are arranged in a manner not necessarily corresponding to their real arrangement, but with a variable pitch to better illustrate how they operate. This is on the understanding that the gripping members 77 (and likewise the gripping members 79) are normally arranged with a constant pitch on the corresponding continuous flexible members 41, 43.

The gripping member indicated as 77X in FIG. 4 has just engaged with the tapered socket C of the portion M1 of the spindle M contained inside a log R that is beginning to move forward along the log advancing path 25.

The numeral 77Y indicates a gripping member that has advanced approximately two thirds of the way along the diverging portion, which is oriented at an angle $\alpha$ in relation to the forward feed direction defined by the arrow $f_R$ of the logs R along the log advancing path 25. Just over half the length of the spindle portion M1 has been removed, i.e. axially extracted from the log. At this stage, the spindle portion M1 is still inserted in the log R as well as being attached to the corresponding gripping member 77.

The numeral 77Z indicates a gripping member that has moved beyond the idle wheel 51 along the closed path defined by the flexible member 41 and it is on the portion of said closed path defined between the wheel 51 and the wheel 53, oriented substantially at a 90° angle in relation to the forward feed direction of the logs R along the log advancing path 25. This gripping member 77Z is holding a spindle portion M1 that has been completely extracted from the corresponding log R. As shown in FIG. 3, and in more detail also in FIG. 2, on both sides of the log advancing path 25 there are supporting means 81, 83 with a rotating or rocking movement controlled by means of actuators 85, 87. These rocker supports 81, 83 serve the dual purpose of supporting the spindle portions M1, M2 when they have been removed completely from the respective logs R, and of transferring said spindle portions M1, M2 towards the two semi-conveyors forming the conveyor 35 for carrying the spindle portions. The supports 81, 83 and the actuators 85, 87 thus constitute transfer means that carry the spindle portions M1, M2 towards the semi-conveyors, indicated as 35A for the spindle portions M1 and as 35B for the portions spindle M2 in FIG. 3.

The positioning of the closed paths defined by the flexible members 41 and 43 in relation to the conveyors 21 and 23 can advantageously be designed so that the two engaging portions of the path, defined between the pairs of wheels 47, 49 and 67, 69, are located at least partially upstream from the conveyors 21 and 23, and overlapping with the area where the logs R are retained by the distributor 27. In this way, each log R advances from the waiting position defined by the distributor 27 to the area where it is collected by the conveyors 21 and 23 thanks to the thrust exerted by the gripping members 77 and 79 along the path portion where they move forward in a direction parallel to the forward feed direction of the log. The diverging portions, or extracting portions, of the closed paths of the gripping members 77 and 79 can be positioned so that the gripping members 77 and 79 begin their diverging movement starting from the point where the logs R come into contact with the conveyors 21, 23.

In this way, the gripping members 77 and 79 advance along their respective engaging portions of the first closed path and second closed path at a speed substantially greater than the speed at which the log moves along said log advancing path. In practice, the speed at which the log advances may be nil at least for a certain period of time, during which the log is withheld by the distributor 27. Along the extracting portion of the first and second closed paths, the first and second gripping members advance at a speed that has a component parallel to the log advancing path and a component orthogonal thereto, the component parallel to the log advancing path having a modulus equating to the modulus of the forward feed speed of the opposite stretches of the conveyors 21, 23 and consequently of the logs R.

Figure 2:
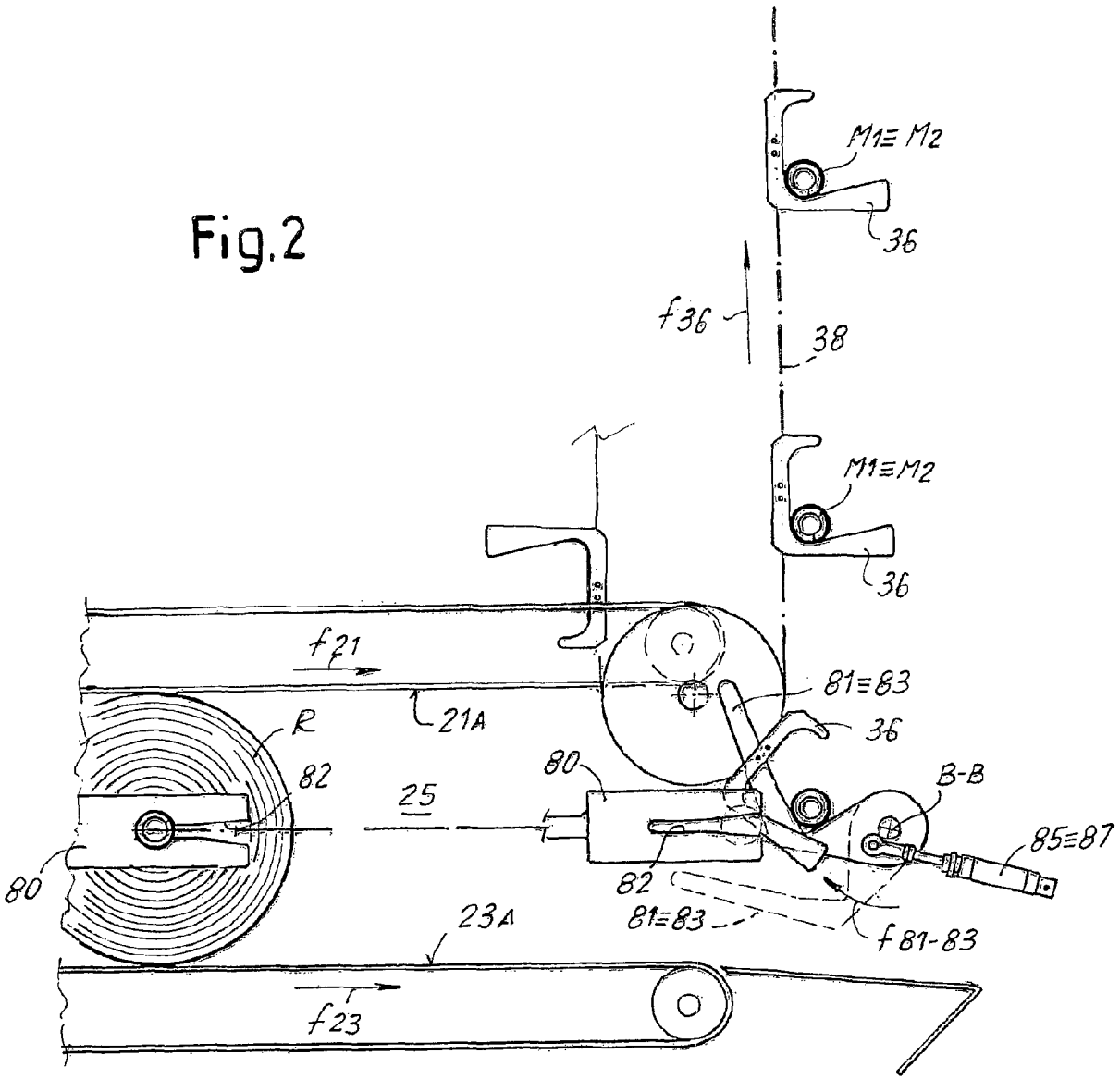
FIG. 2 is an enlargement of a portion of FIG. 1.

The function of the rocker supports 81, 83 is best understood with reference to FIG. 2. In the embodiment illustrated, each pair of rocker supports 81, 83 rotates around a rotational or rocking axis B-B to pass from a position for receiving the respective spindle portion M1, M2 to a position for transferring the spindle portion M1, M2 onto the semi-conveyor 35A or 35B.

In some embodiments, the rotating or rocking supports 81, 83 may be elbow-shaped or V-shaped to form a cradle into which the respective spindle portions M1, M2 are unloaded. As the rotating or rocking supports 81, 83 turn in the direction of the arrow $f_{81}$ (FIG. 2) around the axis B-B, the spindle portion M1, M2 lying on the respective pair of rocker supports 81, 83 is transferred upwards in line with a trajectory along which holders or cradles 36 for receiving the spindle portions M1, M2 are moving. The holders 36 are attached to respective flexible members 38, e.g. chains or belts, of the semi-conveyor 35A or 35B. These holders are shaped so that the combined movement of the holders 36 in the direction $f_{36}$ and of the rocker supports 81 and 83 in the direction $f_{81}$ enable each spindle portion M1 or M2 to be transferred from the supports 81, 83 to the holders 36.

As shown in particular in FIG. 1, the flexible members 36 of each semi-conveyor 35A, 35B of the conveyor 35 extend from the outlet from the conveyors 21, 23, where the holders 36 receive the spindle portions M1 and M2, to the area upstream from the rewinder 3, enabling the spindle portions M1 and M2 to be recirculated. There are means for coupling the portions M1 and M2 in a known manner along the recirculating path, or upstream from the rewinder 3. The spindles M formed by recoupling the portions M1, M2, or the pairs of portions M1, M2, can be transferred from the holders 36 of the conveyor 35 onto cradles 36A of an auxiliary conveyor 35C (FIG. 1) that transfers them to a slide 91 from where they are collected by the conveyor 5.

Figures 5, 6A, 6B, 7:
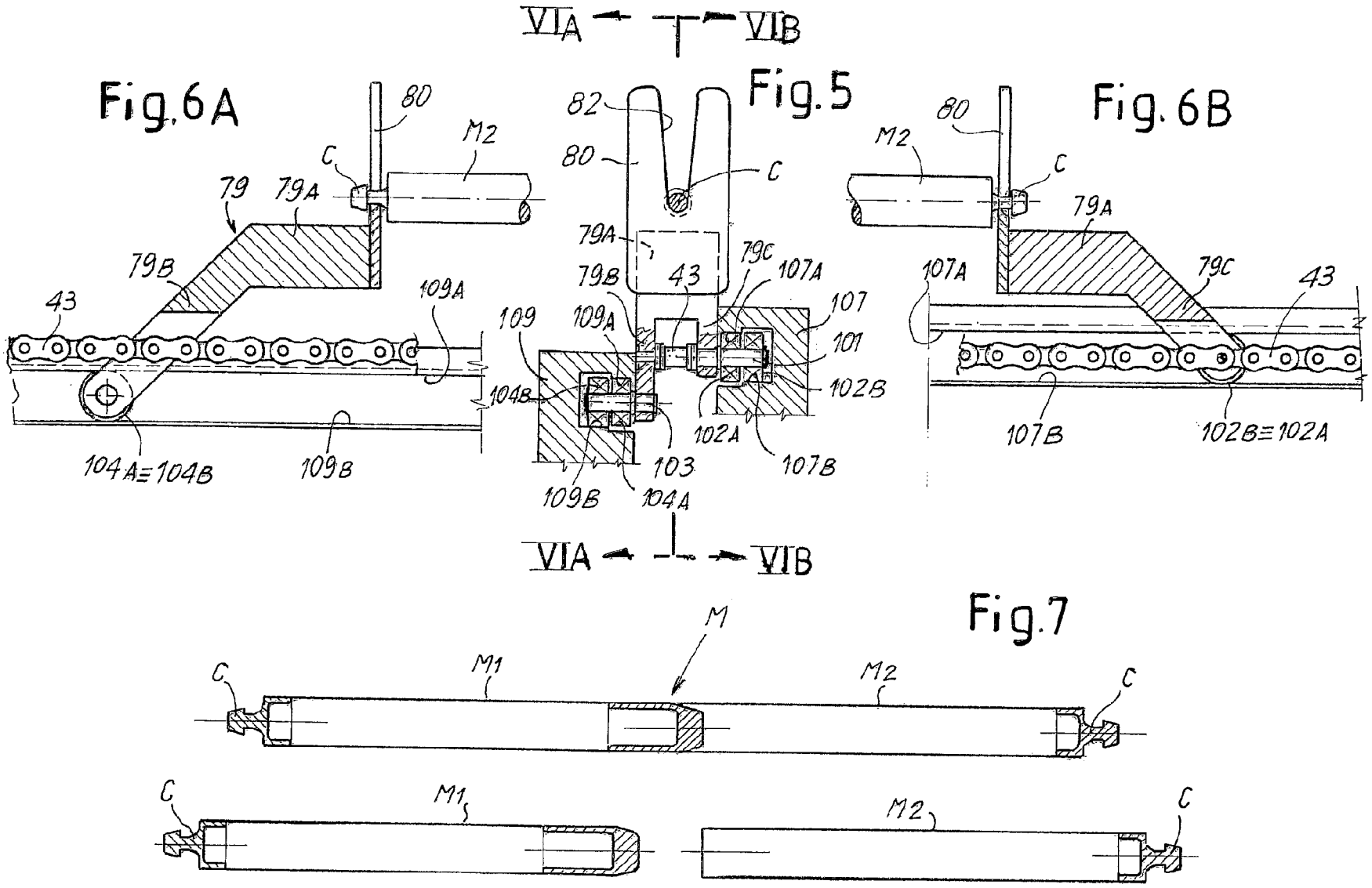
FIG. 5 is a cross-sectional view along V-V of FIG. 4.
FIGS. 6A, 6B are cross-sectional views along $VI_A$-$VI_A$ and $VI_B$-$VI_B$ of FIG. 5.
FIG. 7 is a schematic longitudinal section view of a spindle with its two parts or portions respectively coupled and uncoupled.

The portions M1 and M2 of each spindle M can be coupled and uncoupled by means of a male-female joint, as shown schematically in FIG. 7, which shows a spindle M consisting of two portions M1 and M2 coupled together and a pair of separated portions M1, M2 in respective longitudinal sections containing the axis of the spindle.

In some embodiments, as shown in FIGS. 3 and 4, at least along the portion of their trajectory where the gripping members 77 and 79 engage with the spindle portions M1 and M2, the gripping members 77 and 79 move with a translational motion while remaining parallel to one another. This can be achieved, for instance, by using a guide system as shown schematically in FIGS. 5 and 6, which show an example of a gripping member 79 attached to the second flexible member 43, obviously assuming that a symmetrical system is provided for the gripping members 77.

In this embodiment, each gripping member 79 has a bearing, indicated as 79A for the gripping member 79 and shown in FIGS. 5 and 6, that is attached to the fork 80 and has two appendages 79B and 79C. In the example illustrated, the two appendages 79B, 79C are of different lengths. A pin 101 and a pin 103 are advantageously keyed respectively onto the appendages 79B, 79C.

In advantageous embodiments, each gripping member 79 is jointed to the respective chain or other flexible member 43 in line with the pin 101. As shown in the drawing, the pin 101 advantageously forms an pivoting joint between adjacent links in the chain forming the flexible member 43. The second pin 103 is advantageously approximately parallel to the pin 101 and consequently to the axes of articulation of the links forming the chain 43.

In the embodiment illustrated, the pins 101 and 103 idly support two rollers, respectively 102A, 102B for the pin 101, and 104A, 104B for the pin 103. The pairs of rollers 102A, 102B and 104A, 104B are supported, for instance, by means of revolving bearings, which advantageously roll on parallel surfaces of two respective guides 107 and 109 extending parallel to one another and parallel to the path defined by the flexible member 41 or 43, at least along the portion where the gripping members 77, 79 must remain parallel to one another.

The rolling surfaces of the guides 107 and 109 are indicated as 107A and 107B for the rollers 102A and 102B, and as 109A and 109B for the rollers 104A and 104B. The rolling surfaces are arranged so that each roller can roll on its respective guide surface and the contact between the various rollers and the guide surfaces as a whole keeps the bearing 79A of the gripping member 79 parallel thereto when it is moved by the flexible member 43 to which it is attached.

The operation of the above-described device is already clear from the description provided. Essentially, the logs R are produced by the rewinder 3 and delivered to the gluing device 17, where they are glued before being delivered to the device 19, with the spindle M still inserted therein and projecting with the tapered sockets C of the two portions M1, M2 from the two ends of the logs. Inside the device 19, the two spindle portions engage with two opposite gripping members 77 and 79, that follow and grip the tapered sockets C of the two portions M1, M2. Along the diverging portion of the path defined by the continuous flexible members 41, 43, the gripping members 77, 79 advance longitudinally parallel to and synchronously with the logs, while at the same time they diverge from one another and thus gradually slide the portions M1, M2 of the spindle M out of the log R. Finally, the log R without the spindle is unloaded onto the slide 29 and transferred to a channel 34 of the accumulator 31, while the two portions M1, M2 of the spindle M are unloaded onto the two semi-conveyors 35A, 35B forming the conveyor 35, which returns them towards the rewinder 3.

There may be several logs at a time in the device 19, e.g. two or three logs R. The operations for extracting or removing the spindle M from the logs coincide with the transfer of the log from the gluing device 17 to the stacker 31. This means that the removal of the portions M1, M2 of the spindle does not negatively influence the production rate.

As illustrated so far, the device 19 for extracting the portions M1, M2 of the spindle M from the logs R produced by the rewinder 3 is located downstream from the gluing device 17, between the latter and the log accumulator 31. This enables the device 19 to be constructed in a particularly straightforward manner because it is substantially independent of the operation of the gluing device 17.

The device 19 increases the global length of the winding line, however. In the embodiment shown in FIGS. 8 and 9, on the other hand, the device for extracting the spindle portions M1, M2 from the logs R is incorporated in the gluing device 17. In these figures, the same numbers indicate the same or corresponding parts as those described with reference to FIGS. 1 to 6. The rewinder 3 has the same components as illustrated with reference to FIG. 1.

The gluing device, again indicated globally by the numeral 17, may be designed as described in U.S. Pat. Nos. 6,143,111, 5,242,525 or WO2010100666, for instance.

In a known manner, the gluing device 17 comprises two conveyors, consisting for instance of a series of parallel belts globally indicated as 21 and 23. In this embodiment, the conveyors 21 and 23 of the gluing device 17 also serve at the same time as conveyors for carrying the logs R along the log advancing path 25, which is integrated in the gluing device.

In one embodiment, there is a station 121 for unwinding the tail edge of the logs R in the initial part of the log advancing path 25, while there is a gluing station 123 in the terminal part of the log advancing path 25, inside the gluing device 17. Details of these gluing and unwinding stations 123 and 121 are not provided herein because they are already known to those skilled in the art. Further details can be obtained from the above-mentioned patent documents.

In some embodiments, the single logs R are placed on the log advancing path 25 by a distributor 127, arranged downstream from a slide 129 connecting the gluing device 17 to the rewinder 3.

The closed paths along which the gripping members 77 and 79 advance, defined by the continuous flexible members 41 and 43, run substantially alongside the log advancing path 25, between the conveyors 21 and 23 of the gluing device 17. The movement of the continuous flexible members 41 and 43 is synchronised with the movement of the conveyors 21 and 23 and consequently with the operation of the gluing device 17.

The structure and operation of the gripping members 77 and 79, and of their respective drive means, are substantially the same as those described with reference to FIGS. 1 to 6.

The end of the conveyor 35 which receives the spindle portions M1 and M2 is preferably approximately in line with the gluing station 123, or directly downstream therefrom. The spindle portions M1, M2 can be transferred to the conveyor 35 using means similar to the transfer means 81, 83, 85, 87 described with reference to the embodiment in FIGS. 1 to 7, and not shown in FIGS. 8 and 9.

Figure 8:
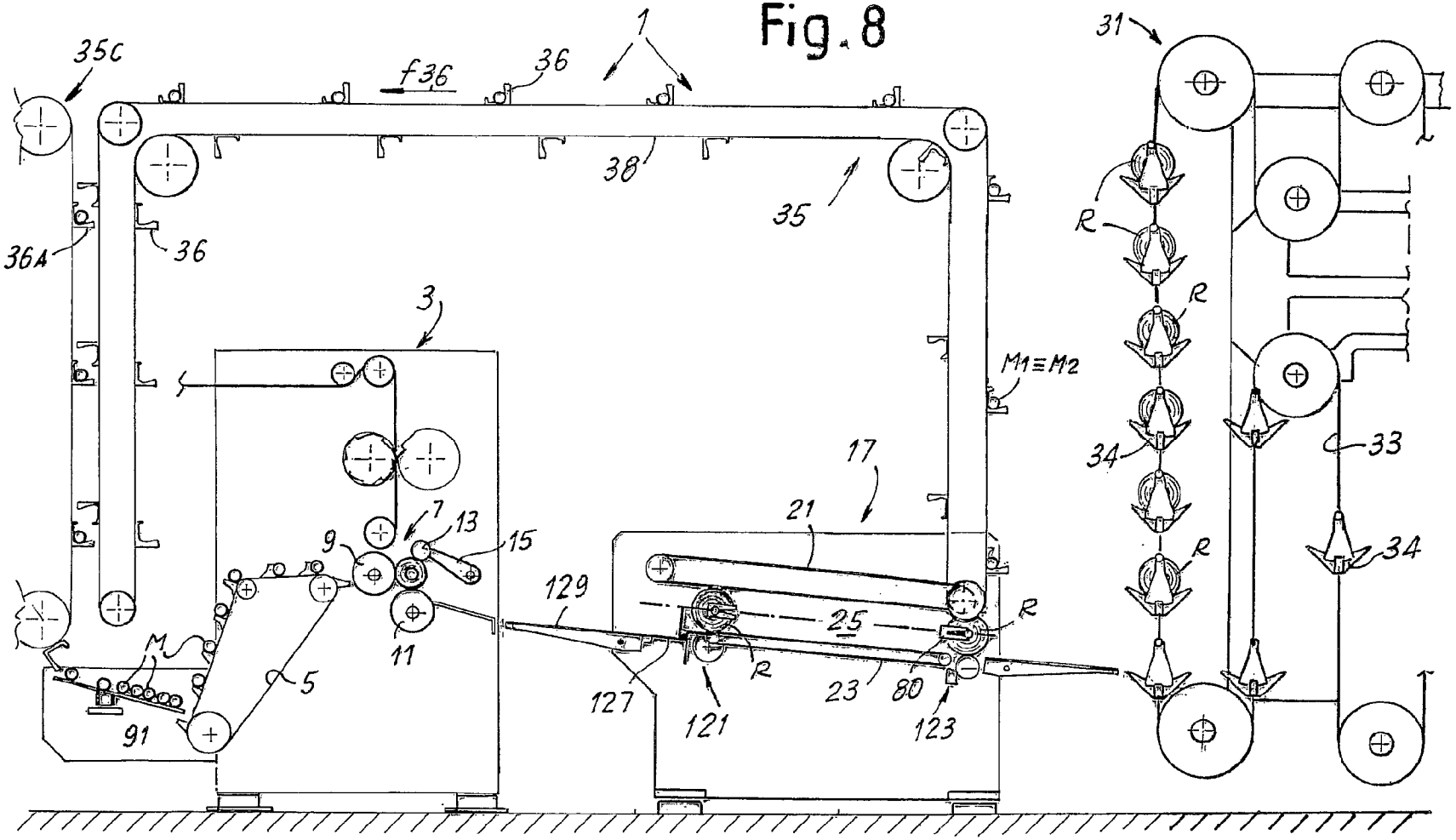
FIG. 8 is a schematic side view of a portion of winding line for producing logs of web material in a second embodiment.
Figure 9:
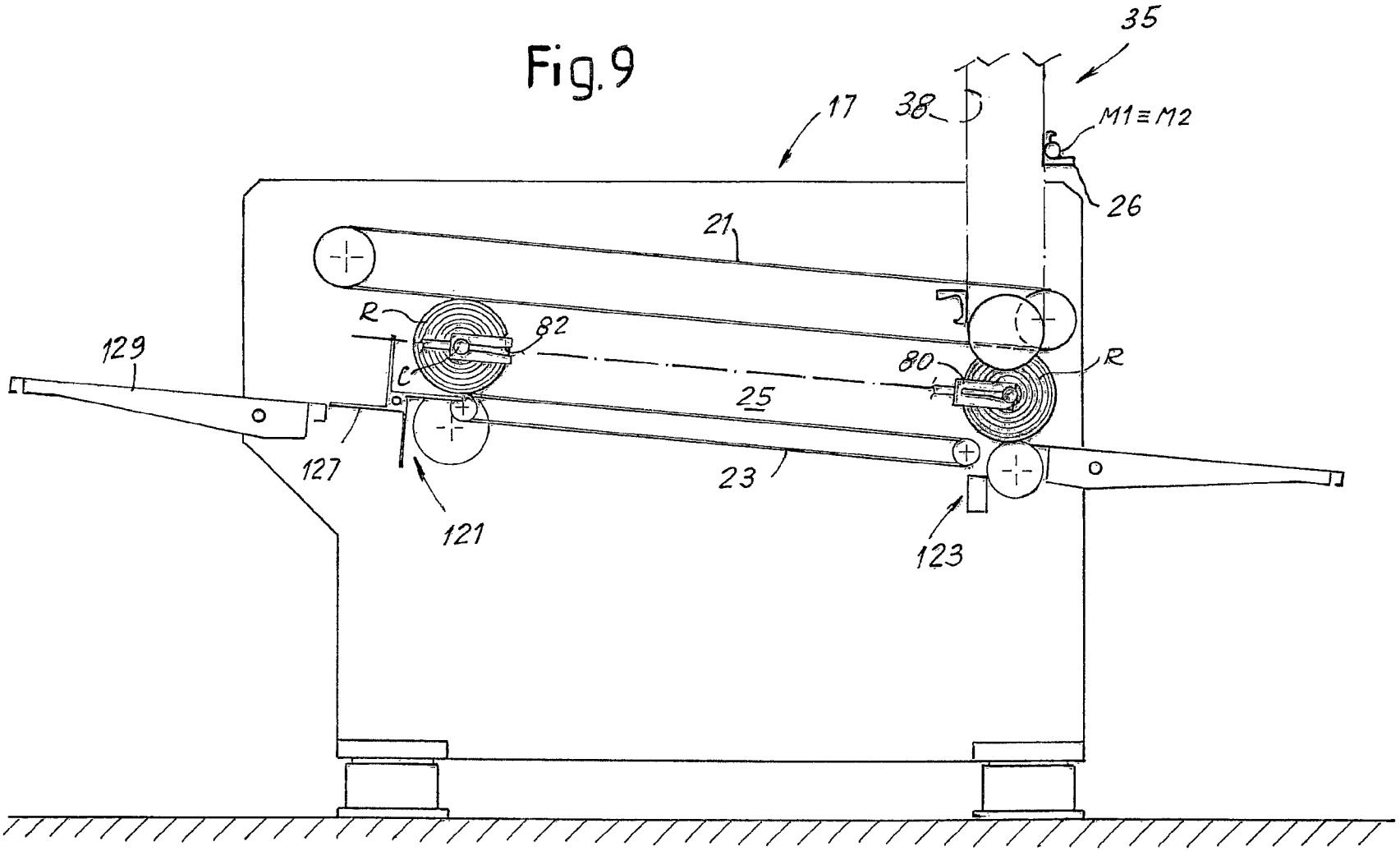
FIG. 9 is an enlargement of a portion of the line in FIG. 8.

The embodiment illustrated in FIGS. 8 and 9 consequently constitutes a substantially more compact configuration of the log winding line as a whole because the spindle portions M1 and M2 are extracted from the log R as it moves along the log advancing path inside the gluing device 17, and therefore without increasing the overall longitudinal footprint of the processing line.

Figure 10:
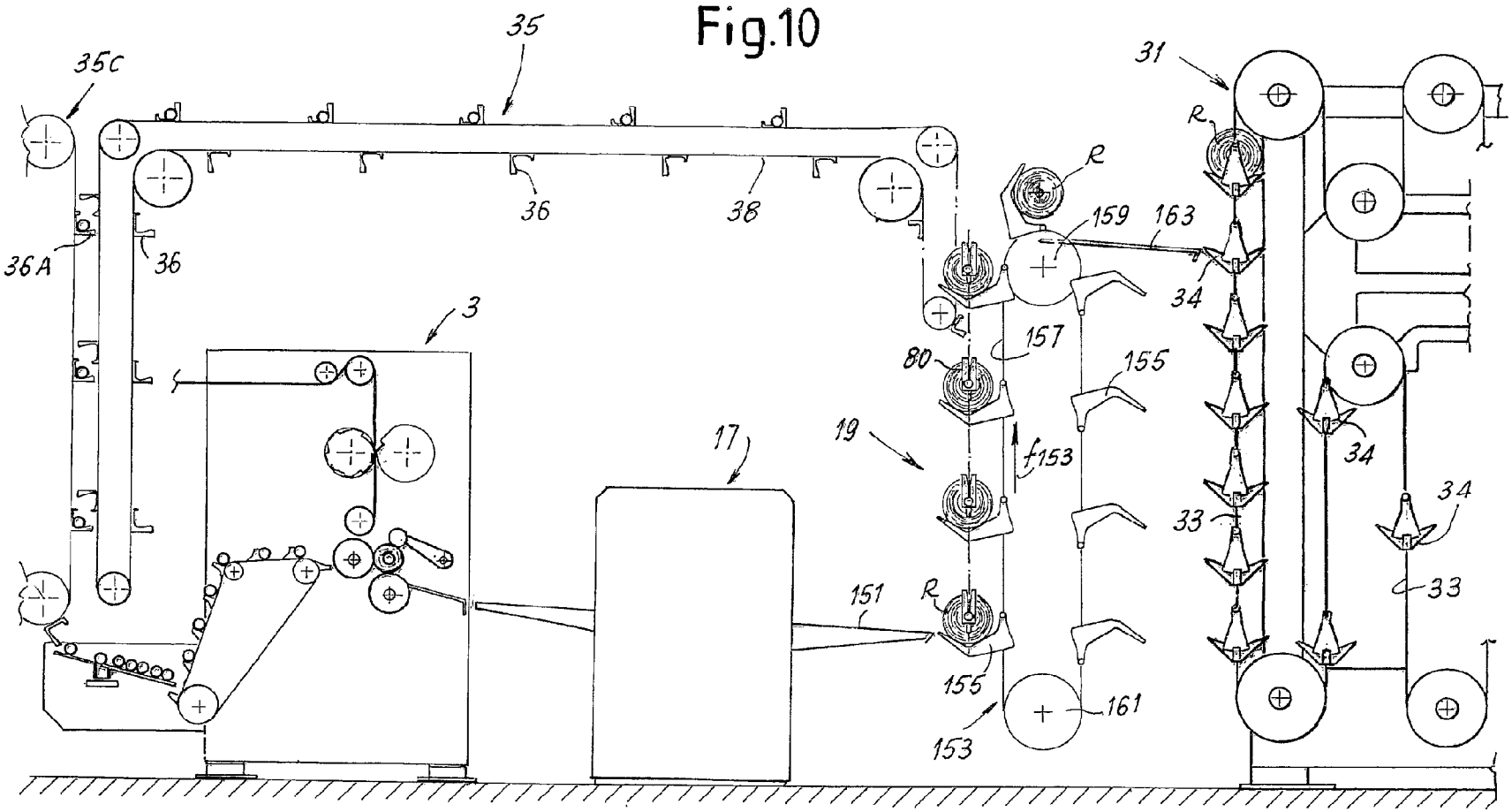
FIG. 10 is a schematic side view of a portion of a web material winding line for producing logs in a third embodiment.
Figure 12:
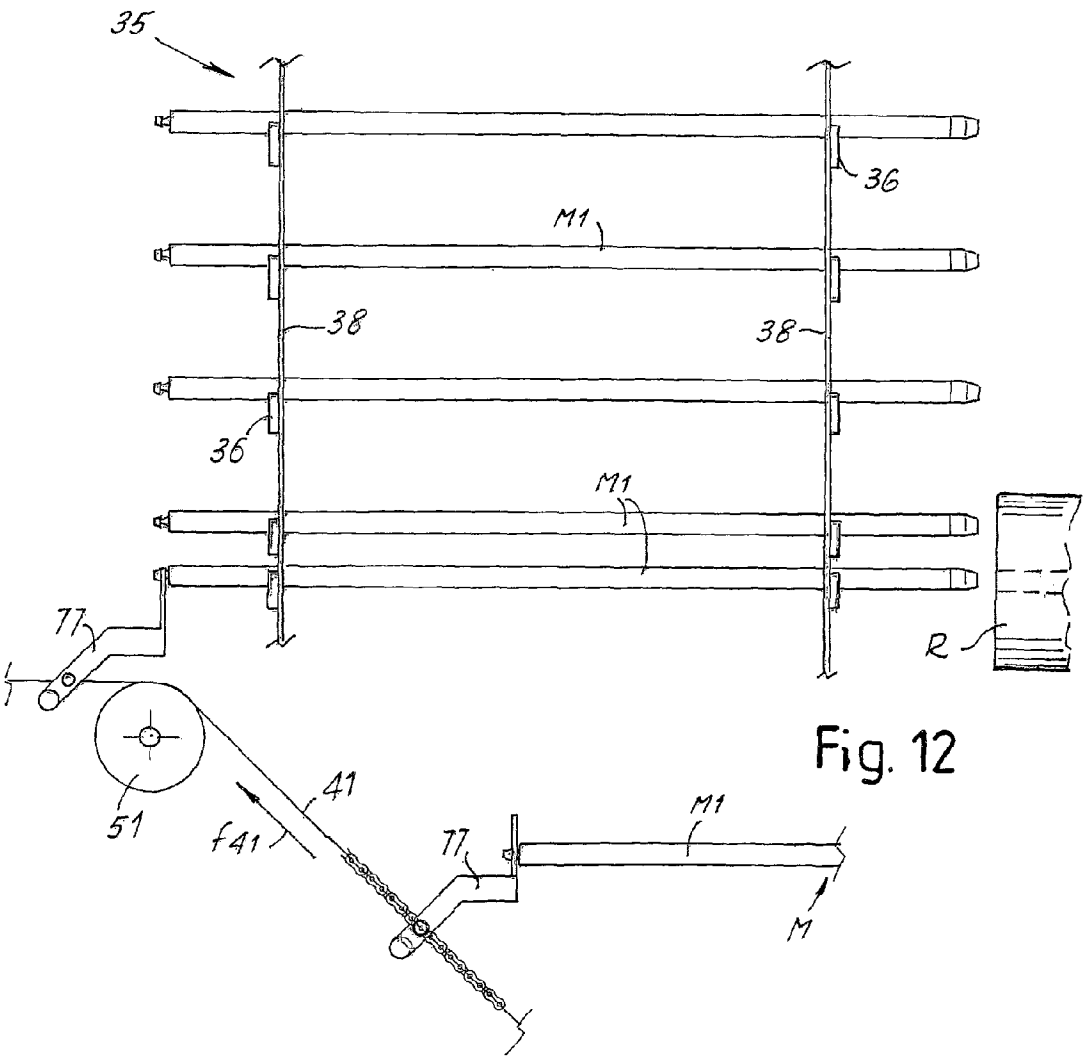
FIG. 12 is a view of half of the system for extracting the spindles along XII-XII of FIG. 11.
Figure 11:
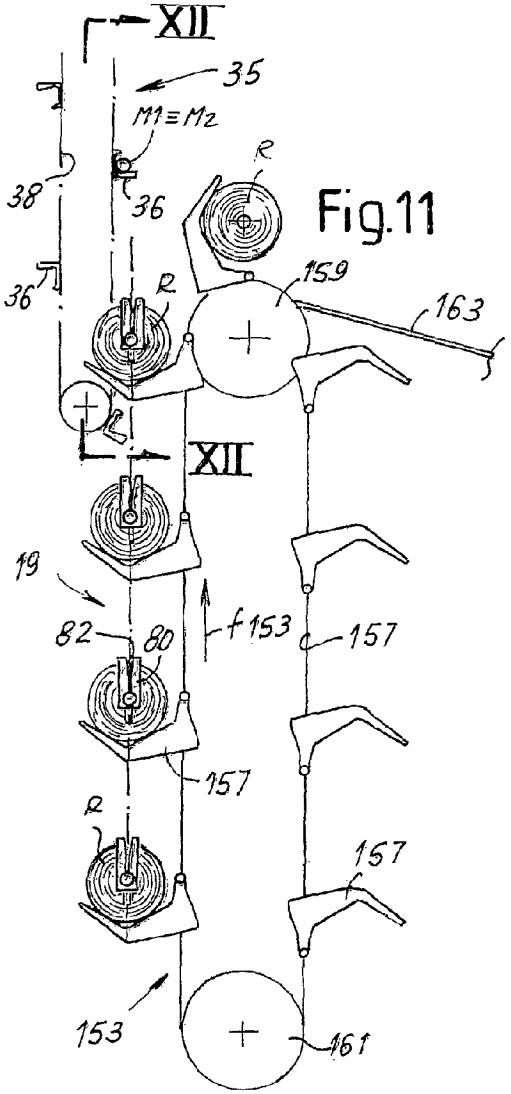
FIG. 11 is a detail of the area for loading the logs in an accumulator or storage unit at the area where the spindle portions are extracted.

FIGS. 10 to 12 show a third embodiment of the invention, wherein the device 19 for extracting the spindle portions M1 and M2 is still positioned between the gluing device 17 and the log stacker 31. In this case, however, the device 19 extends in a vertical direction to reduce the overall footprint of the processing line in which the device 19 is inserted.

The structure and operation of the device 19 are easy to understand from the schematic illustration in FIGS. 10 to 12, and from the above description with reference to FIGS. 1 to 7.

In this third embodiment, the logs containing the winding spindles M are delivered along a slide 151 between the outlet from the gluing device 17 and an elevator conveyor 153, which has a series of channels 155 driven, by means of chains 157 or other suitable flexible members jointed to said channels, along a closed path defined between two pulleys or chain wheels 159 and 161. The elevator conveyor 153 lifts the logs R from the level where they are unloaded downstream from the slide 151, up to the level of another slide 163, along which the logs are transferred by rolling under the effect of gravity from the elevator conveyor 151 to the accumulator 31, which can be made in a manner similar to the one illustrated with reference to FIG. 1.

The device for extracting the portions M1 and M2 of spindle M is positioned along the upward stretch of the elevator conveyor 153, along which the channels 155 are driven upwards, in the direction of the arrow $f_{153}$.

Here again in this embodiment, the device 19 can have a first series of gripping members 77 and a second series of gripping members 79, made substantially as described with reference to the previous figures and carried by continuous flexible members 41 and 43 that, in this embodiment, define closed paths lying on a vertical plane instead of a horizontal plane, as represented schematically in FIG. 12.

The movement of the flexible members 41 and 43 is controlled so that, along a first, substantially vertical portion of the path along which the gripping members 77, 79 move, the latter advance in a substantially vertical direction at a faster speed than the speed at which the logs R are lifted along the rising stretch of the elevator conveyor 153. As a result, the gripping members 77, 79 follow and ultimately engage with the tapered sockets C of the portions M1, M2 of spindle M in much the same way as described with reference to the first embodiment. In the subsequent diverging sections of the two closed paths defined by the continuous flexible members 41, 43, the gripping members 77, 79 move at a speed that has a vertical component (which is consequently parallel to the movement in which the logs advance along the rising stretch of the elevator conveyor 153) equating to the speed at which the logs are lifted, and also a horizontal component. The diverging orientation of the continuous flexible members 41, 43 along this portion of the path ensures that the spindle portions M1, M2 held by the gripping members 77, 79 of each pair of gripping members are gradually extracted from the logs R until they are removed completely from said logs, remaining on the holders 36 carried by the chains or other flexible members 38 of the conveyor 35, which is basically the same as the conveyor 35 described with reference to FIG. 1, expect that it has a portion alongside and parallel to the rising stretch of the elevator 153, in order to be able to receive the spindle portions M1, M2 as they are removed from the logs R.

All the embodiments illustrated above offer the following advantage: the portions M1, M2 of the winding spindles M are gradually extracted from the logs produced by the rewinder 3 without any need to stop the logs, as they move on the path along which they travel through the winding line. In the first and third embodiments, the portions M1, M2 of spindle M are extracted along a portion of the path that the logs travel from the gluing device 17 to the stacker 31. In the second embodiment (FIGS. 8 and 9), on the other hand, they are extracted on the path along which the logs travel inside the gluing device 17. In all these cases, the time taken to extract the portions M1, M2 of winding spindle M does not add to the processing time needed to wind the logs and perform other related actions, because the spindles are extracted while other log processing or transfer steps are underway (steps that are necessary anyway, even if the spindles were not extractable, but intended to remain inside the logs).

This solution enables extractable and reusable winding spindles to be used even where it is unfeasible to increase the processing time for each log without penalizing the global productivity of the processing line.

Another advantage of the embodiments illustrated lies in that the portions M1, M2 of the winding spindles M are extracted simultaneously from more than one log, e.g. from three logs at a time, and this further reduces the time it takes to complete the removal of the spindles, consequently facilitating the inclusion of this step while other actions are being performed on the logs.

In the second embodiment described herein, the extraction system is incorporated in an existing station on the winding line, i.e. in the gluing device, and this has the additional advantage of leaving the overall footprint of the processing line unaffected and reducing the total number of components required because some of the components of the gluing device can also form part of the components needed to extract the spindles from the logs.

The drawings are attached hereto on the understanding that they only provide a practical demonstration of the invention, which may vary in shape and arrangement without departing from the scope of the invention. Any reference numbers in the attached claims are used merely to facilitate the reading of said claims with reference to the description and to the drawings, and shall not be construed to limit the scope of the invention as described in the claims in any way.

What is claimed is:

1. A device for extracting a winding spindle from a log of web material wound around said winding spindle, said winding spindle being in two portions, comprising at least a first gripping member and a second gripping member constructed and arranged to extract said two winding spindle portions, which together as said winding spindle extend lengthwise through the log of web material, from opposite ends of a log, moving in a longitudinal extraction direction parallel to an axis of the log, wherein said first gripping member and said second gripping member are movable along a log advancing path and extract said two winding spindle portions as said two winding spindle portions advance together with the log along said log advancing path.

2. The device according to claim 1, wherein said first gripping member and said second gripping member are arranged to move along diverging trajectories alongside the log advancing path.

3. The device according to claim 1, wherein said first gripping member and said second gripping member respectively form part of a first series of gripping members and a second series of gripping members, each of which comprises a plurality of gripping members.

4. The device according to claim 2, wherein said first gripping member and said second gripping member respectively form part of a first series of gripping members and a second series of gripping members, each of which comprises a plurality of gripping members.

5. The device according to claim 3, wherein the plurality of gripping members of said first series of gripping members are structured to move along a first closed path and the plurality of gripping members of said second series of gripping members are structured to move along a second closed path, and wherein said first closed path and said second closed path comprise two active portions substantially symmetrical to said log advancing path.

6. The device according to claim 4, wherein the plurality of gripping members of said first series of gripping members are structured to move along a first closed path and the plurality of gripping members of said second series of gripping members are structured to move along a second closed path, and wherein said first closed path and said second closed path comprise two active portions substantially symmetrical to said log advancing path.

7. The device according to claim 5, wherein said two active portions diverge from one another.

8. The device according to claim 6, wherein said two active portions diverge from one another.

9. The device according to claim 5, wherein said first series of gripping members and said second series of gripping members are respectively connected to a first continuous flexible member and a second continuous flexible member, which define said first closed path and said second closed path along which the plurality of gripping members in the first series of gripping members and the plurality of gripping members in the second series of gripping members are respectively moved.

10. The device according to claim 7, wherein said first series of gripping members and said second series of gripping members are respectively connected to a first continuous flexible member and a second continuous flexible member, which define said first closed path and said second closed path along which the plurality of gripping members in the first series of gripping members and the plurality of gripping members in the second series of gripping members are respectively moved.

11. The device according to claim 7, wherein said first closed path and said second closed path define an engaging portion, along which the first closed path and the second closed path lie substantially parallel to one another and to a forward feed direction of the logs along said log advancing path, and an extracting portion, along which the first closed path and the second closed path diverge; said first gripping member and said second gripping member being opposite one another and moving respectively along the first closed path and along the second closed path, advancing along the engaging portion to engage with opposite ends of a winding spindle extending from the opposite ends of a log, and then advancing along the extracting portion to extract said two winding spindle portions from the log.

12. The device according to claim 8, wherein said first closed path and said second closed path define an engaging portion, along which the first closed path and the second closed path lie substantially parallel to one another and to a forward feed direction of the logs along said log advancing path, and an extracting portion, along which the first closed path and the second closed path diverge; said first gripping member and said second gripping member being opposite one another and moving respectively along the first closed path and along the second closed path, advancing along the engaging portion to engage with opposite ends of a winding spindle extending from the opposite ends of a log, and then advancing along the extracting portion to extract said two winding spindle portions from the log.

13. The device according to claim 11, wherein said first gripping member and said second gripping member are arranged so that they advance:

a) along said engaging portion of the first closed path and the second closed path at a speed substantially faster than that of the log, b) and then along said extracting portion of the first closed path and the second closed path at a speed that has one of said gripping members parallel to the log advancing path and one of said gripping members orthogonal to the log advancing path, the one of said gripping members parallel to the log advancing path having a modulus equating to forward feed speed modulus of the log.

14. The device according to claim 12, wherein said first gripping member and said second gripping member are arranged so that they advance:

a) along said engaging portion of the first closed path and the second closed path at a speed substantially faster than that of the log, b) and then along said extracting portion of the first closed path and the second closed path at a speed that has one of said gripping members parallel to the log advancing path and one of said gripping members orthogonal to the log advancing path, the one of said gripping members parallel to the log advancing path having a modulus equating to forward feed speed modulus of the log.

15. The device according to claim 1, wherein at least one conveyor is provided along said log advancing path, which makes the logs advance along at least a part of said advancing path.

16. The device according to claim 15, wherein said conveyor is constructed and arranged to make the logs advance with a translational motion in a direction substantially orthogonal to the axis of the logs.

17. The device according to claim 16, wherein said conveyor comprises at least a pair of continuous belts that define two overlapping and substantially parallel branches between which said logs are engaged and made to advance.

18. The device according to claim 1, wherein a log accumulator is located downstream from the log advancing path to receive logs from which said two winding spindle portions have been extracted.

19. The device according to claim 1, further comprising a conveyor for conveying the two winding spindle portions extracted from the logs.

20. The device according to claim 19, wherein said conveyor comprises a first semi-conveyor and a second semi-conveyor associated with said first closed path and said second closed path for receiving respective ones of said two winding spindle portions.

21. The device according to claim 20, wherein said first semi-conveyor and said second semi-conveyor respectively define a first recirculating conveyor and a second recirculating conveyor for carrying respective ones of the two winding spindle portions towards an area for coupling of the respective ones of the two winding spindle portions.

22. The device according to claim 20, wherein for each of said first closed path and the second closed path, said conveyor comprises at least one respective rocker support that transfers respective ones of the two winding spindle portions to respective ones of the first semi-conveyor and the second semi-conveyor.

23. The device according to claim 7, wherein the plurality of gripping members of said first series of gripping members and the plurality of gripping members of said second series of gripping members are respectively connected to a first conveyor member and to a second conveyor member, and wherein said first conveyor member and said second conveyor member are configured so as to make each of said plurality of gripping members advance along said active portions of the first closed path and the second closed path with a translational motion, maintaining each gripping member parallel to itself.

24. The device according to claim 1 further comprising a gluing device positioned and structured to glue tail ends of logs of web material wound around the winding spindles.

25. The device according to claim 24, wherein the gluing device comprises a first station where the tail ends of the logs are opened and a second station where glue is applied, wherein said device for extracting a winding spindle is arranged between said first station and said second station.

26. The device according to claim 24 further comprising a pair of overlapping flexible conveyors defining a log advancing path, wherein said first gripping member and said second gripping member are arranged to engage with and extract the two winding spindle portions from the logs while said logs advance between said two flexible conveyors.

27. The device according to claim 25, further comprising a pair of overlapping flexible conveyors defining a log advancing path, wherein said first gripping member and said second gripping member are arranged to engage with and extract the two winding spindle portions from the logs while said logs advance between said two flexible conveyors.

28. The device according to claim 25, further comprising a pair of overlapping flexible conveyors defining a log advancing path, wherein said first gripping member and said second gripping member are arranged to engage with and extract the two winding spindle portions from the logs while said logs advance between said two flexible conveyors, and wherein said overlapping flexible conveyors extend at least partially between said first station and said second station.

29. A device for extracting a winding spindle from a loci of web material wound around said winding spindle, comprising at least a first gripping member and a second gripping member constructed and arranged to extract two winding spindle portions from opposite ends of a log, moving in a longitudinal extraction direction parallel to an axis of the log, wherein said first gripping member and said second gripping member are movable along a log advancing path and extract said two winding spindle portions as said two winding spindle portions advance together with the log along said log advancing path; a conveyor for conveying the two winding spindle portions extracted from the logs; and a transfer device for transferring the two winding spindle portions from the gripping members to said conveyor.

30. The device according to claim 29, wherein said transfer device comprises rocker supports structured to receive and support the two winding spindle portions for transfer to said conveyor.

31. A method for extracting a winding spindle from a log of web material wound around the winding spindle, said winding spindle being made in two portions, which together as the winding spindle extend lengthwise through the log of web material, extractable from opposite ends of the log by a first gripping member and a second gripping member, comprising advancing said log along an advancing path while said two portions of the winding spindle are gradually extracted from the log by said first gripping member and said second gripping member, wherein said first gripping member and said second gripping member advance together with the log along the advancing path.

32. The method according to claim 31, wherein the log advances along the advancing path with a translational motion in a direction substantially orthogonal to an axis of the log.

33. The method according to claim 31, wherein a plurality of pairs of said first gripping member and said second gripping member simultaneously engage with a plurality of two extractable portions of respective winding spindles present in a plurality of logs.

* * * * *